US005950851A

United States Patent [19]

Clodfelter et al.

[11] Patent Number: 5,950,851

[45] Date of Patent: Sep. 14, 1999

[54] SAFETY CLOSURE AND CONTAINER HAVING BIASING MEANS

[75] Inventors: Christopher B. Clodfelter; William D. Sprick, both of Evansville, Ind.

[73] Assignee: Rexam Plastics Inc., Evansville, Ind.

[21] Appl. No.: 08/934,360

[22] Filed: Sep. 19, 1997

[51] Int. Cl.[6] ..... B65D 41/04

[52] U.S. Cl. ..... 215/334; 215/336; 215/337; 215/339; 215/340; 215/349

[58] Field of Search ..... 215/272, 316, 215/317, 334, 339, 340, 341, 342, 343, 344, 349, 354, DIG. 1, 44, 336, 337, 345, 224, 252

[56] References Cited

U.S. PATENT DOCUMENTS

| | | | |
|---|---|---|---|
| 2,063,428 | 12/1936 | Goebel . | |
| 2,063,615 | 12/1936 | Merolle | 215/334 X |
| 2,079,932 | 5/1937 | Fergusson | 215/334 |
| 2,752,060 | 6/1956 | Martin . | |
| 3,064,844 | 11/1962 | Hoffman | 215/45 |
| 3,159,298 | 12/1964 | Saw | 215/DIG. 1 X |
| 3,820,683 | 6/1974 | Jasinski . | |
| 3,917,097 | 11/1975 | Uhlig . | |
| 3,958,708 | 5/1976 | Le Brun, Jr. . | |
| 3,984,021 | 10/1976 | Uhlig . | |
| 3,993,208 | 11/1976 | Ostrowksy . | |
| 4,116,351 | 9/1978 | Uhlig . | |
| 4,117,945 | 10/1978 | Mumford . | |
| 4,138,028 | 2/1979 | Price et al. . | |
| 4,387,818 | 6/1983 | Conti | 215/45 X |
| 4,410,098 | 10/1983 | Dubs et al. | 215/252 X |
| 4,413,743 | 11/1983 | Summers . | |
| 4,471,878 | 9/1984 | Davis et al. . | |
| 4,482,070 | 11/1984 | Dubach | 215/317 X |
| 4,535,906 | 8/1985 | Rowerkamp | 215/334 X |
| 4,567,991 | 2/1986 | Anderson . | |
| 4,635,808 | 1/1987 | Nolan | 215/252 |
| 5,181,624 | 1/1993 | Petit | 215/334 X |

FOREIGN PATENT DOCUMENTS

| | | | |
|---|---|---|---|
| 2376798 | 9/1978 | France | 215/334 |
| 2458600 | 6/1976 | Germany | 205/334 |

*Primary Examiner*—Stephen K. Cronin
*Assistant Examiner*—Robin A. Hylton
*Attorney, Agent, or Firm*—Middleton & Reutlinger; John F. Salazar; Charles G. Lamb

[57] ABSTRACT

A safety closure including a top wall having a first diameter, an outer cylindrical shell depending downwardly from the top wall first diameter, an inner cylindrical shell depending downwardly from a second diameter of the top wall, and a retaining flange projecting inwardly and downwardly from a lower edge of said inner shell opposite said top wall. The inner shell second diameter is less than the top wall outer diameter, and the inner shell is coaxial with the outer shell. The retaining flange is engageable with an underside surface of a locking bead provided on an external surface of the container neck, thereby maintaining a constant downwardly-directed axial force being imposed on the safety closure, which results in a constant upwardly-directed radial force being imposed on the sealing gasket by an upper terminal lip of the container neck.

5 Claims, 7 Drawing Sheets

SAFETY CLOSURE AND CONTAINER HAVING BIASING MEANS

BACKGROUND OF THE INVENTION

1. Technical Field of the Invention

The present invention relates to safety closures for use on containers. More particularly, the present invention relates to a safety closure for use on a container wherein the safety closure is provided with enhanced retaining means.

2. Discussion of the Prior Art

It is often desirable to provide a fluid-impervious seal between a container and a safety closure fitted thereupon, such as, for example, when the container is filled with a liquid. However, it is often difficult to provide an efficient fluid-impervious seal between the container and the safety closure due to an imperfect fit therebetween. It is thus desirable to provide a safety closure for use on a container wherein the safety closure provides an enhanced seal therebetween.

It is well known in the prior art to dispose a flexible gasket within the safety closure, and more particularly, within an inner region of the safety closure engageable with an upper terminal end of the container neck. Fitting the safety closure upon the container neck, such as, for example, by threading, forces the upper terminal end of the container neck to sealingly engage a lower surface of the flexible gasket, which receives the upper terminal end of the container neck and provides a fluid-impervious seal therebetween. However, even nominal unthreading of the safety closure from the container neck causes the upper terminal lip of the container neck to be drawn downwardly away from the flexible gasket, thereby breaking the sealing contact therebetween. This situation is even more severe for other means of fitting the safety closure upon the container neck, such as, for example, by a snap bead, which often results in a great deal of potential for relative axial movement between the upper terminal end of the container neck and the safety closure before the safety closure is removed therefrom. It is therefore desirable to provide a safety closure for use on a container wherein the safety closure is provided with sealing means, such as, for example, an integral sealing gasket, therein to engage the upper terminal end of the container neck.

Various attempts have heretofore been made to provide a safety closure having a sealing gasket disposed therein. For example, U.S. Pat. No. 4,138,028 to Price, et al., teaches a safety closure having a sealing liner to provide sealing contact with an upper terminal end of a container neck, as well as an annular retaining flange for secondary sealing contact with an outer annular surface of the container neck. However, it is further desirable to provide a safety closure for use on a container wherein the safety closure is provided with means for maintaining a sealing engagement therebetween.

For example, U.S. Pat. No. 2,752,060 to Martin teaches a container closure having a flange engageable with an annular shoulder provided on a container neck, wherein the flange and the shoulder cooperate to provide a continuous sealing force between an upper terminal edge of the container neck and a gasket provided on an underside surface of the container closure. Until the present invention, however, use of such a retaining flange to maintain a continuous sealing force between the container neck and the gasket has been limited to closures having only a single annular shell. For those so-called "double-shelled closures" wherein the closure is provided with a concentric inner annular shell in addition to an outer annular shell, the geometry of the molding dies typically used in forming same often result in a rigid flange being incapable of removal from the molding die. As such, manufacturing of a double-shelled closure having a retaining flange provided on the inner annular shell required expensive equipment and complicated manufacturing processes. It is therefore desirable to provide a double-shelled safety closure for use on a container wherein a continuous sealing force is provided between the container and the safety closure by means of a flexible retaining flange provided on an inner annular shell of the closure.

SUMMARY OF THE INVENTION

It is an object of the present invention to provide a safety closure for use on a container neck wherein the safety closure is provided with sealing means therein for sealingly engaging an upper terminal end of the container neck.

It is another object of the present invention to provide a safety closure for use on a container wherein the safety closure is provided with sealing means therein for sealingly engaging an upper terminal end of a container neck and wherein the safety closure is provided with means for maintaining the sealing engagement between the upper terminal end of the container neck and the sealing means.

It is yet another object of the present invention to provide a double-shelled safety closure for use on a container wherein a continuous sealing force is provided between the container and the safety closure by means of a flexible retaining flange provided on an inner annular shell of the closure.

A safety closure according to the present invention is provided for use on a container neck and includes a top wall having a first diameter, an outer cylindrical shell depending downwardly from the top wall first diameter, an inner cylindrical shell depending downwardly from a second diameter of the top wall, and a retaining flange projecting inwardly and downwardly from a lower edge of said inner shell opposite said top wall, the second diameter being less than the first diameter, the inner shell being coaxial with the outer shell.

The retaining flange is engageable with an underside surface of a locking bead provided on an external surface of the container neck, thereby maintaining a constant downwardly-directed axial force being imposed on the safety closure, which results in a constant upwardly-directed radial force being imposed on the sealing gasket by an upper terminal lip of the container neck.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
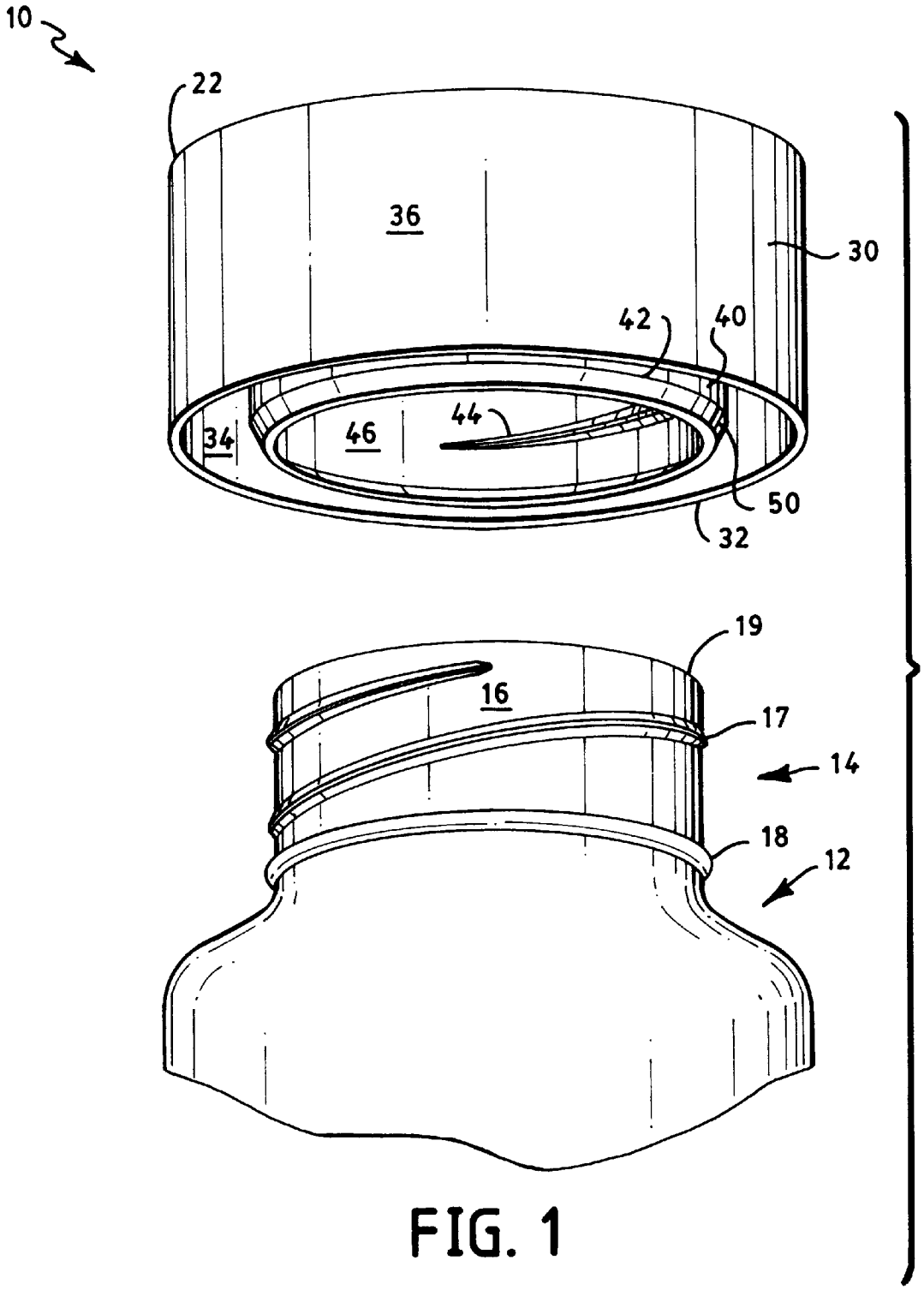
FIG. 1 is a top perspective view of a safety closure according to a preferred embodiment of the present invention shown spaced above a container neck.

With reference to FIG. 1, a safety closure 10 according to the preferred embodiment of the present invention for use on a container 12 includes a top wall 20 (FIG. 3) having a perimeter 22, an outer cylindrical shell 30 depending downwardly from the top wall perimeter 22, an inner cylindrical shell 40 depending downwardly from the top wall 20 and being coaxial with the outer shell 30, and a flexible retaining flange 50 projecting inwardly and downwardly from a lower edge 42 of the inner shell 40. An internal thread 44 projects inwardly from an inner annular surface 46 of the inner shell 40. The container 12 includes a neck portion 14 having an outer annular surface 16, an external thread 17 projecting outwardly from the outer annular surface 16, and a sealing bead 18 projecting outwardly from the outer annular surface 16 between the container 12 and an upper terminal end 19 thereof. The closure 10 and the container 12 may be made from any sufficiently light-weight material, such as, for example, polyethylene or polypropylene.

Figure 2:
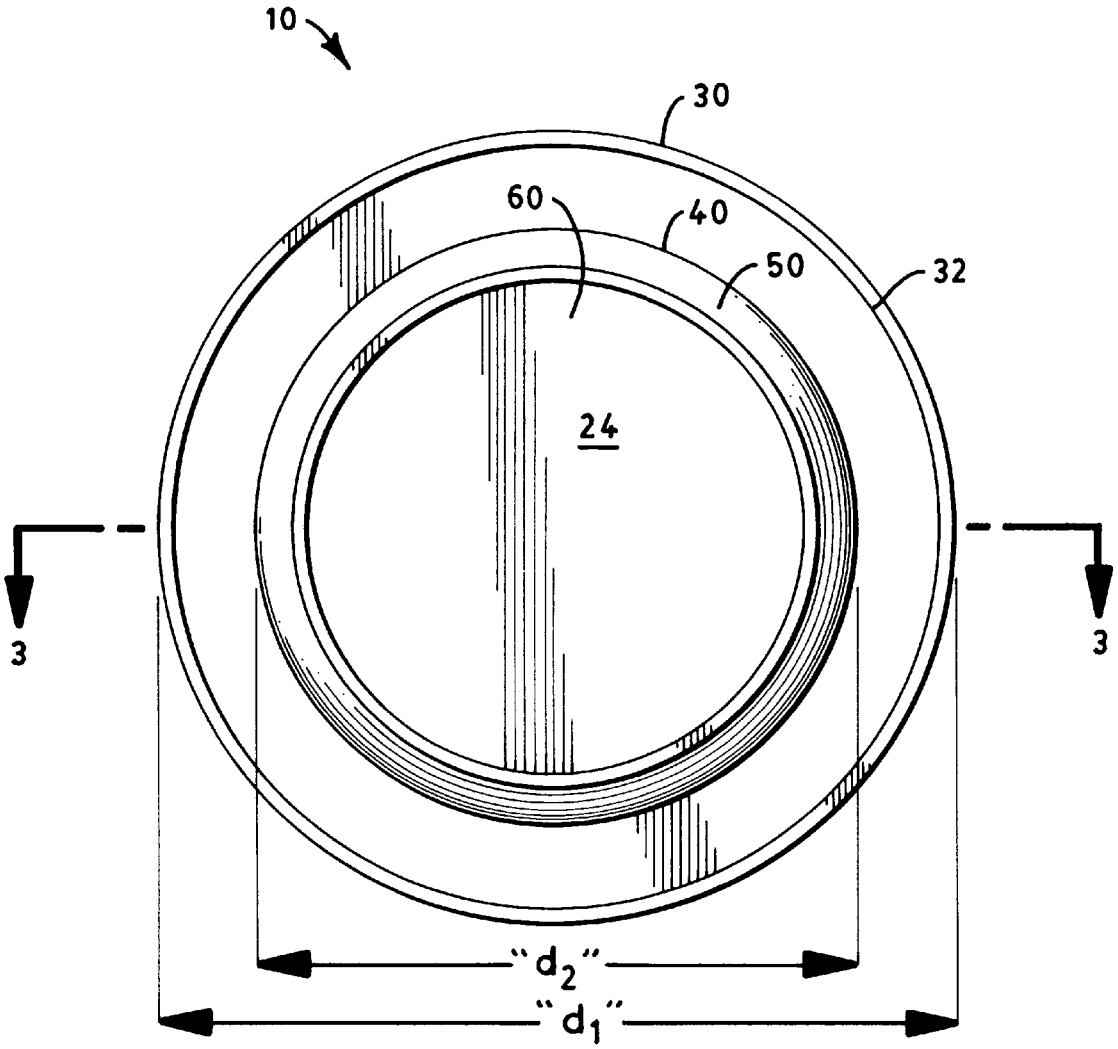
FIG. 2 is a bottom view of the safety closure of FIG. 1.

With reference to FIG. 2, the outer shell is of a first diameter "$d_1$" which is coincident with the top wall perimeter 22 and the inner shell 40 is of a second diameter "$d_2$" which is less than the first diameter "$d_1$". The retaining flange 50 is of a third diameter "$d_3$" (FIG. 3) which is less than the second diameter "$d_2$", the retaining flange 50 being sized to receive container neck sealing bead 18.

Figure 3:
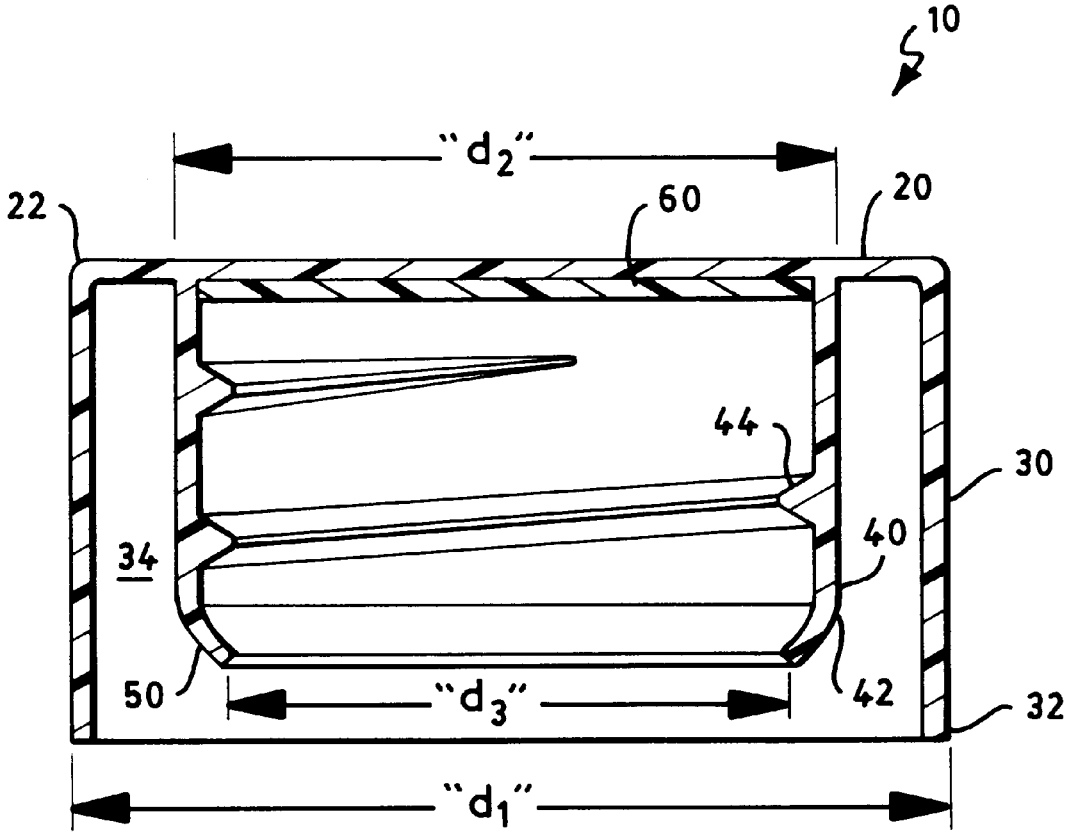
FIG. 3 is a sectional view of the safety closure of FIG. 1, taken along section line 3—3 of FIG. 2.

With reference to FIG. 3, a sealing gasket 60 is disposed on an underside surface 24 (FIG. 2) of the top wall 20 within an area defined by the inner shell second diameter "$d_2$" and is constructed of a sufficiently flexible material to permit the upper terminal end 19 (FIG. 4) of the container neck 14 to be received therein, thereby defining a fluid-impervious seal therebetween.

Figure 3A:
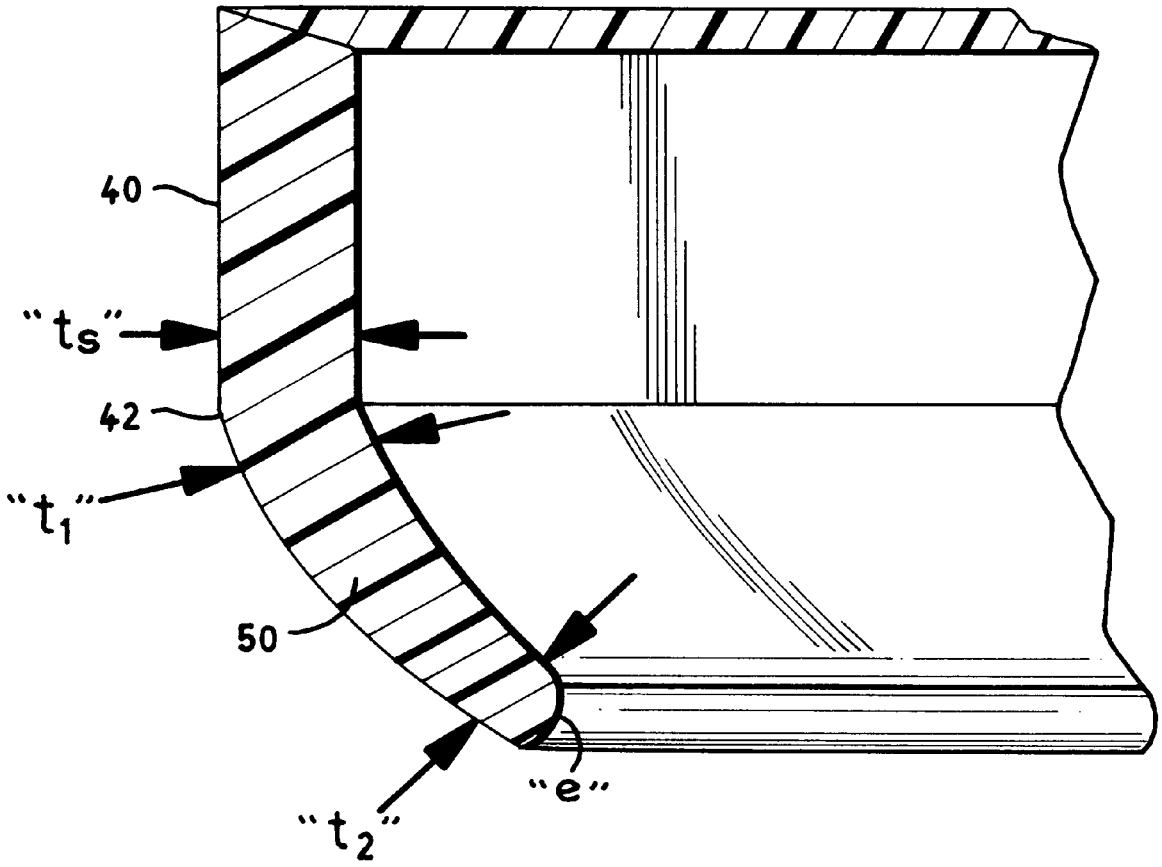
FIG. 3*a* is a detail view of one component of the safety closure of FIG. 1.

With reference to FIG. 3*a*, the retaining flange 50 is integrally molded with, and projects inwardly and downwardly from, the lower edge 42 of the inner shell 40. The retaining flange 50 includes a first thickness "$t_1$" being substantially equivalent to a thickness "$t_s$" of the inner shell 40 towards the lower edge 42 thereof. The retaining flange 50 further includes a second thickness "$t_2$" being less than the first thickness "$t_1$" and a tapered edge "e". The substantially tapered cross-section of the retaining flange 50 provides increased flexibility thereof, which is important, such as, for example, when the safety closure 10 is being formed, where the retaining flange 50 must be permitted to flex outwardly to overcome interfering components of the molding die.

Figure 4:
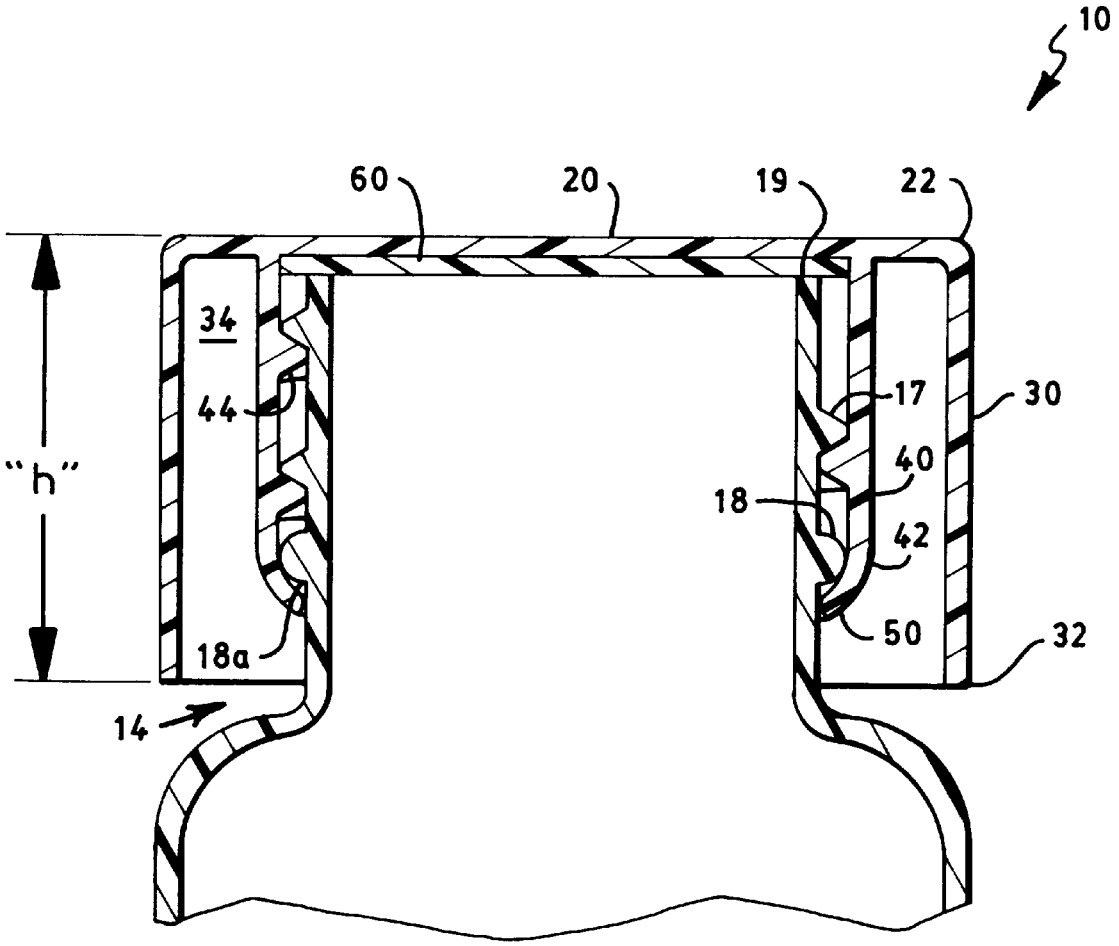
FIG. 4 is a sectional view of the safety closure with the container of FIG. 1, taken along section line 3—3 of FIG. 2.

With reference to FIG. 4, a safety closure 10 is fitted upon the container neck 14, such as, for example, by engaging the safety closure internal thread 44 with the container neck external thread 17, so that the upper terminal end 19 of the container neck 14 is received by the sealing gasket 60. The retaining flange 50 is disposed a distance "h" from the top wall such that as the upper terminal end 19 of the container neck 14 is being received by the sealing gasket 60, the retaining flange 50 passes to an underside surface 18*a* of the sealing bead 18. The natural resiliency of the material chosen for the sealing gasket 60 imposes a generally upwardly-directed force on the safety closure 10, which is negated by an opposing downwardly-directed force imposed on the safety closure 10 by the natural resiliency of the retaining flange 50. These operating forces prevent the safety closure 10 from "creeping" or "backing off" from the container neck and provide an enhanced liquid-impervious seal therebetween. Upward force is imposed on the sealing gasket 60 by the upper terminal end 19 of the container neck 14, thereby drawing the upper terminal end 19 of the container neck 14 deeper into the sealing gasket 60 and increasing the sealing integrity thereof.

Figure 5:
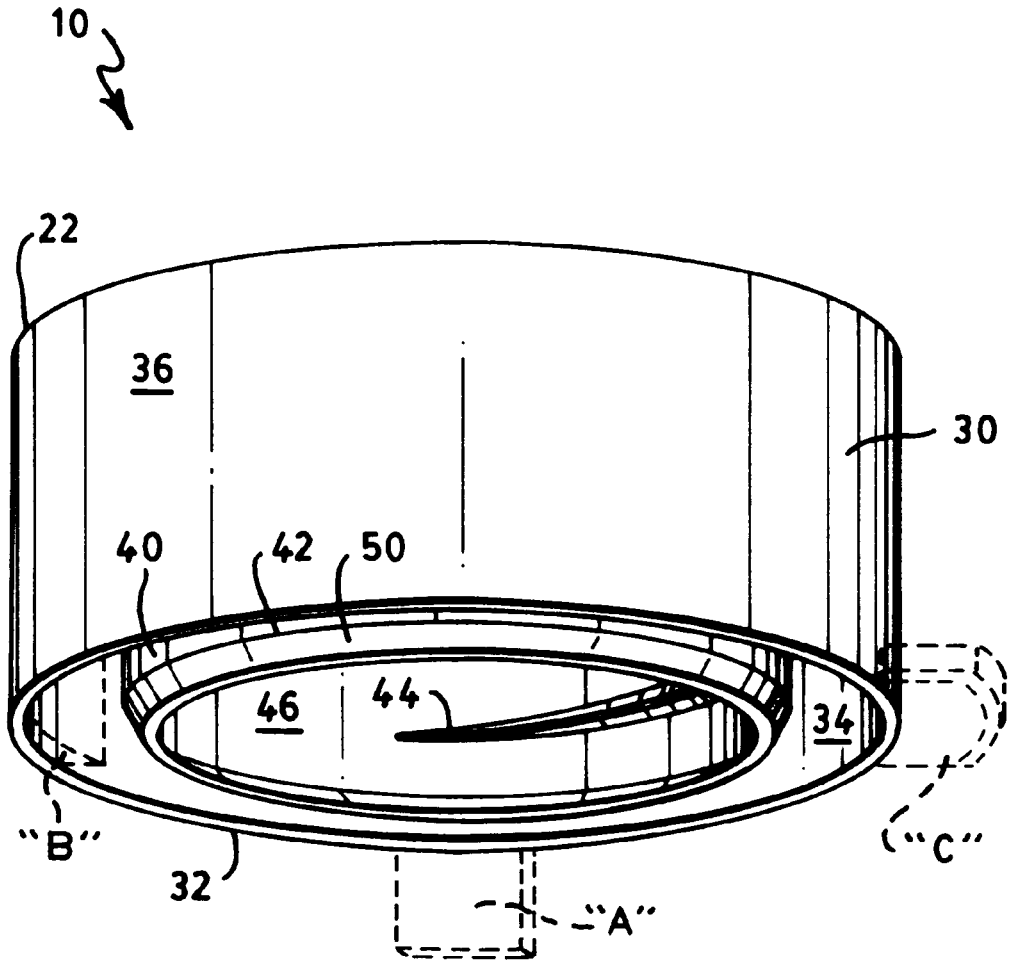
FIG. 5 is a top perspective view of a safety closure according to another embodiment of the present invention; and, FIG. 6 is a top perspective view of a safety closure according to another embodiment of the present invention shown spaced above a container neck.

With reference to FIG. 5, another embodiment of the present invention is shown which shares many elements in common with the preferred embodiment and wherein like reference numerals are intended to represent like elements. In particular, according to the present embodiment of the present invention, the outer shell 30 is provided with at least one locking lug projecting therefrom, such as, for example, downwardly from a lower end 32 of the outer shell 30 and as represented by hidden lines as reference numeral "A", inwardly from an inner surface 34 of the outer shell 30, and as represented by hidden lines as reference numeral "B", or outwardly from an outer surface 36 of the outer shell 30, and as represented by hidden lines as reference numeral "C". With respect to each alternative locking lug, the safety closure lug "A", "B" and "C" is sized to engage a mating locking lug (not shown) provided on the outer surface 16 of the container neck 14.

Figure 6:
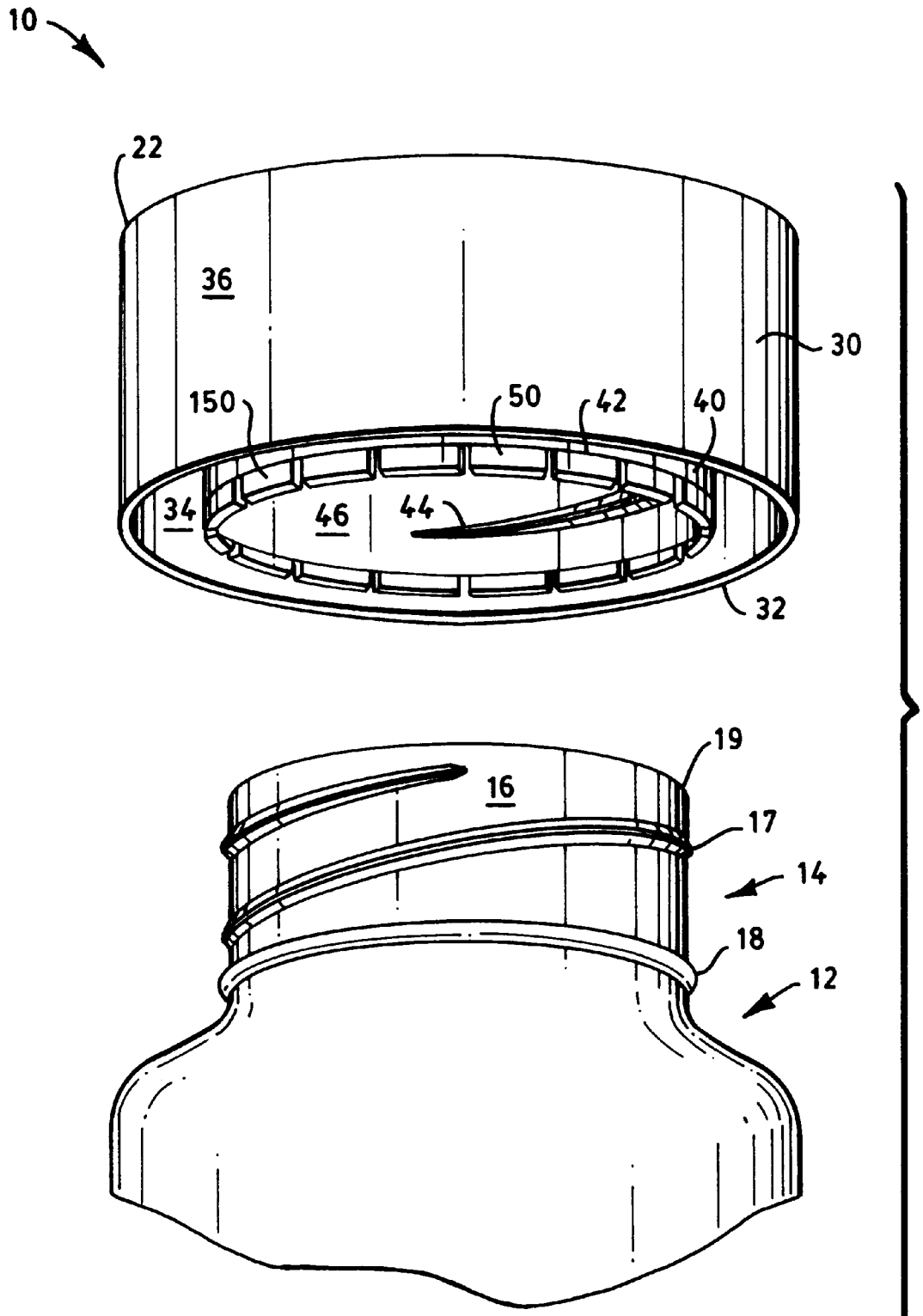

With reference to FIG. 6, yet another embodiment of the present invention is shown which shares many elements in common with the preferred embodiment and wherein like reference numerals are intended to represent like elements. In particular, the continuous retaining flange 50 (FIG. 1) of the preferred embodiment is replaced with a plurality of retaining flange arcuate segments 150 which cooperate to form a discontinuous retaining flange engageable with sealing bead 18 provided on the outer annular surface 16 of the container neck 14. The size and shape of the arcuate segments 150 will depend on the material chosen therefor and the amount of sealing force required to be sustained thereby.

In yet still another embodiment of the present invention, and with reference back to FIG. 3, the sealing gasket 60 is replaced with an integrally-molded sealing lip (not shown) depending downwardly and inwardly from the underside surface 24 of the top wall 20. The sealing lip (not shown) is sized to engage the upper terminal end 19 of the container neck 14 and provide a liquid-impervious seal therebetween.

The foregoing detailed description is given primarily for clearness and understanding and no unnecessary limitations are to be understood therefrom as modifications will become obvious to those skilled in the art upon reading this disclosure and may be made without departing from the spirit of the present invention.

We claim:

1. A safety closure and container combination, comprising: a container having a sealing bead having an upper, an outer, and a lower surface provided on a neck portion thereof; and, a safety closure having (a) a top wall:

(b) an outer shell depending downwardly from said top wall, said outer shell having a first diameter;

(c) an inner shell depending downwardly from said top wall, said inner shell having a second diameter, said inner shell second diameter being less than said outer shell first diameter; and, (d) a retaining flange projecting inwardly and downwardly from said inner shell, said retaining flange engaging said container neck portion sealing bead on said outer and lower surfaces to downwardly bias said safety closure on said container neck portion.

2. The safety closure and container combination according to claim 1, further comprising:

a sealing means disposed on an underside surface of said top wall within said inner shell.

3. The safety closure and container combination according to claim 2, wherein said sealing means comprises:

a sealing gasket.

4. The safety closure and container combination according to claim 1, wherein said retaining flange comprises:

a plurality of flange segments.

5. The safety closure and container combination according to claim 1, further comprising:

an internal thread disposed on an inner annular surface of said inner shell.

* * * * *